US007908855B2

(12) United States Patent
Smith

(10) Patent No.: US 7,908,855 B2
(45) Date of Patent: Mar. 22, 2011

(54) FLUIDIC OSCILLATOR

(75) Inventor: Thomas Charles Brannam Smith, Cambridge (GB)

(73) Assignee: Thermofluidics Ltd., Cambridge (GB)

( * ) Notice: Subject to any disclaimer, the term of this patent is extended or adjusted under 35 U.S.C. 154(b) by 678 days.

(21) Appl. No.: 11/629,253

(22) PCT Filed: Jun. 9, 2005

(86) PCT No.: PCT/GB2005/002278

§ 371 (c)(1), (2), (4) Date: Feb. 13, 2008

(87) PCT Pub. No.: WO2005/121539

PCT Pub. Date: Dec. 22, 2005

(65) Prior Publication Data

US 2008/0156373 A1 Jul. 3, 2008

(30) Foreign Application Priority Data

Jun. 10, 2004 (GB) ..... 0412868.2
Jan. 17, 2005 (GB) ..... 0500864.4

(51) Int. Cl.
*F01B 29/08* (2006.01)

(52) U.S. Cl. ..... 60/516; 60/517; 60/522; 60/523; 60/524

(58) Field of Classification Search ..... 60/516–526
See application file for complete search history.

(56) References Cited

U.S. PATENT DOCUMENTS 3,574,475 A * 4/1971 Wolff ..... 415/17
3,765,182 A * 10/1973 Warren ..... 60/412

FOREIGN PATENT DOCUMENTS

DE 27 56 585 A1 6/1979
FR 2 518 184 A 6/1983
GB 2 017 227 10/1979

OTHER PUBLICATIONS

International Search Report for corresponding PCT/GB2005/002278, completed Aug. 30, 2005 by L. Kolby of the EPO.

* cited by examiner

*Primary Examiner* — Hoang M Nguyen

(57) ABSTRACT

The invention relates to fluidic oscillators including compressed gas driven pumps and liquid piston and thermoacoustic heat engines and heat pumps in which the intention is to generate large amplitude oscillations by eliminating the dependence of the oscillations on inertia. According to the principle embodiment represented by circuit 200 pressure or temperature variations 27' drive pressure variations in vessel 11' causing a flow of further working fluid between vessel 11' and load 12' wherein useful work is consumed. Said flow varies out of phase with said pressure variations in vessel 11' by a first phase angle determined by inter alia the dissipative load 12' and the capacity of vessel 11'. Oscillations are sustained due to a second phase angle determined by inter alia subcircuit 13' comprising dissipative processes 260, 262 and capacitive processes 261, 263 wherein each said dissipative process comprises any one, or combination of the following: viscous drag, thermal resistance or mechanical friction and each capacitive process comprises any one, or combination of the following: hydrostatic pressure change due to a flow, fluid compressibility, thermal capacitance, or elasticity; and wherein, the magnitude of the pressure changes in the working fluid increases or remains constant with time due to at least one mechanism giving rise to a gain.

15 Claims, 13 Drawing Sheets

FLUIDIC OSCILLATOR

This invention relates to a fluidic oscillator. More particularly, but not exclusively, the invention relates to a fluidic oscillator in which there is provided means for giving rise to a phase shift between pressurisation and displacement in a fluid contained therein. Even more particularly, but not exclusively, the invention relates to a pump comprising such a fluidic oscillator.

The class of device referred to herein as a fluidic oscillator typically refers to a system in which a flow of energy is coupled to an oscillation in a fluid.

Fluidic oscillators provide a means to generate useful work from heat sources, pressurised fluid sources, or other types of energy source. Conversely, they may also transform work in order to perform a useful function, such as compressing gases, pumping liquids, heat pumping and cooling. Fluidic oscillators are distinguished from other similar devices by not relying on mechanical pistons, turbines, flywheels, springs, linkages and externally actuated valves. Examples of fluidic oscillators include liquid piston heat engines, air and water pulsejets, thermoacoustic engines and float valve actuated pumps.

In these devices a working fluid undergoes cyclic pressure variations which give rise to (e.g. heat engine), or originate from (e.g. heat pump) oscillatory displacement in a load. The characteristics of the load determine the 'load phase angle' between a displacement of a given part of the working fluid and a pressure thereof at a given position and time.

A means of arranging a 'feedback phase angle' between the displacement and the pressure supplied or dissipated by an energy source or sink must also be provided. The load and feedback phase angles must be approximately equal under non-transient conditions. The optimal value of the load and feedback phase angles is typically around 90°.

In thermofluidic oscillators (e.g. fluidic oscillators of the heat engine or heat pump classes), a second, thermal, feedback phase angle also exists. This thermal phase angle arises due to the time delay between the temperature at which heat is exchanged and the rate of flow of entropy between the working fluid and heat exchangers at a given position and time. The optimal value of the thermal phase angle depends on the nature of the working fluid, however it is typically close to 0°.

There are a number of types of fluidic oscillators, for example pulsejets (see for example GB2180299), water pulsejets (see for U.S. Pat. No. 3,898,800 and U.S. Pat. No. 4,057,961) and many thermoacoustic engines and thermoacoustic coolers (see for example U.S. Pat. No. 4,489,553 and U.S. Pat. No. 5,901,556). All of the aforementioned types of fluidic oscillators may be sub-classed as 'LRC (Inductance-Resistance-Capacitance) feedback' oscillators in which the phase angle between displacement and pressurisation is determined by the extent of an inductive process, 'L', a dissipative process, or resistance, 'R', and a capacitive process, 'C'. Typically, the inductive process arises due to the inertia of the working fluid, the dissipative process is thermal resistance that causes the dissipation of exergy, or available work contained within the system and the capacitive process arises due to the compressibility of the working fluid. In some examples, the dissipative process is friction or viscous drag and the capacitive process is associated with a hydrostatic pressure increase due to a flow of fluid, usually but not necessarily the working fluid, (see for example GB2017227). An LRC thermal phase angle is always between 0° and 90°, and high values imply a very large dissipative loss and consequential poor energy efficiency. Therefore typical practical LRC thermal phase angles are between 30° and 60°.

Another class of fluidic oscillators may be sub-classed as 'LC (Inductance—Capacitance) feedback' oscillators, typical examples of such LC feedback oscillators are liquid piston Stirling engines (see for example GB1581748, GB1507678) and thermoacoustic Stirling engines (see for example U.S. Pat. No. 4,114,380). In these thermofluidic oscillators the feedback phase angle may be close to 90° and the thermal phase angle may be close to 0°, typically with a small dissipative contribution.

The advantage of LC feedback oscillators over LRC feedback oscillators is that no trade off between dissipative losses and the thermal and feedback phase angles is required. Thus, near 90° load and feedback phase angles and a 0° thermal phase angle, are realisable in practical systems.

The disadvantage of LC feedback oscillators is that only one running frequency can be attained practically with a given apparatus and load. It is also necessary to add significant reactance in the region of the load in order to achieve steady state oscillations, prevent the running frequency from being very high and the pressure amplitude from being very low. This has the further disadvantage of making LC feedback oscillators large and operable across only limited loads and pressure amplitudes.

There are also float actuated pumps (see for example U.S. Pat. No. 3,905,724, FR2758162) which cannot be considered as linear oscillators as they depend on rapid switching. In these devices, a float is situated within a chamber which is connected to suction and discharge lines via respective suction and discharge non-return valves. Further valves (e.g. slide or pitot valves) connected to high and low pressure sources cause the float to rise due to an intake of liquid through the suction valve when the further valves are arranged to place the chamber in communication with a low pressure source. The float rises unimpeded until it nears the top of the chamber, when it causes the further valves to switch out the low pressure source and switch in the high pressure source simultaneously. This causes the float to descend unimpeded as liquid is discharged until the float gives rise to the switching in of the low pressure source and to the switching out of the high pressure source as the float reaches the bottom of the chamber, thus the cycle repeats.

The disadvantages associated with these devices include the need to locate switching means at both ends of the chamber. Also, the float must move a large distance before switching if a large displacement is to be achieved without requiring that the further valves have a critically adjusted actuation pressure, or the chamber becoming undesirably large.

According to the present invention there is provided a fluidic oscillator comprising a vessel arranged to contain a working fluid, the oscillator being arranged to permit steady oscillations independently of the inertia of said working fluid.

According to an aspect of the present invention there is provided a fluidic oscillator arranged to permit steady oscillations independently of the inertia of a working fluid further comprising:

a. first and second vessels arranged to contain a working fluid;
b. means for conjoining the first and second vessels so as to subject said two vessels to a common pressure;
c. means for coupling the working fluid in the first vessel to a load such that changes in the volume of the working fluid contained in said first and second vessels give rise to transfer of work between the first vessel and the load;
d. means for communicating the volume of working fluid contained within the first vessel to the second vessel;

e. means for giving rise to pressure changes in the working fluid, located substantially within the second vessel;

f. At least one time delay mechanism giving rise to a phase shift between the volume of working fluid contained within the first vessel and the pressure changes therein. The at least one time delay mechanism being arranged to be independent of the inertia of the working fluid.

According to another aspect of the present invention, said fluidic oscillator comprises two or more time delay mechanisms, the two or more time delay mechanisms each comprising a dissipative process comprising any one, or combination, of the following: viscous drag, thermal resistance or mechanical friction; and a capacitive process comprising any one, or combination of the following: hydrostatic pressure change due to a flow, fluid compressibility, thermal capacitance, or elasticity; and wherein, the magnitude of the pressure changes in the working fluid increases or remains constant with time due to at least one mechanism giving rise to a gain.

According to a further aspect of the present invention there is provided a fluidic oscillator comprising:

a. A vessel arranged to contain a working fluid;

b. Liquid coupling means arranged to couple said working fluid to a load such that changes in the volume of working fluid contained within said vessel give rise to displacement of said liquid and transfer of work between said vessel and the load;

c. Means of connecting said vessel to reservoirs of high or low pressure giving rise to changes of pressure within said vessel;

d. Means of communicating the volume of working fluid within said vessel to said means of connecting said vessel to high or low pressure reservoirs;

e. Two or more time delay mechanisms arranged to give rise to a phase difference between the volume of working fluid contained within said vessel and said pressure changes therein, the time delay mechanisms each comprising a dissipative process and a capacitive process wherein one of said time delay mechanisms comprises the viscous drag between said pressure reservoir and said vessel and the compressibility of the working fluid and one or more other time delay mechanisms comprise any one, or combination, of the following: viscous drag, hydrostatic pressure change due to flow, thermal resistance, fluid compressibility, thermal capacitance, friction or elasticity;

f. Pressure sources having a pressure difference therebetween coupled to said pressure reservoirs.

In the aspects of the present invention that comprise a fluidic oscillator, the fluidic oscillator may further comprise the optional features described hereinafter. The fluidic oscillator may comprise float means having a lower density than that of said liquid. Typically, said float means may have approximately half the density of said liquid. Said float means may be arranged to give rise to a reservoir of high pressure being connected to said vessel or said first vessel when the volume of working fluid is substantially small therein and to a low pressure reservoir when the volume of working fluid therein is substantially large.

The float means may be situated within said vessel such that said float means is actuated by the liquid level therein. Said float means may be connected to said vessel or said first vessel such that mechanical friction between the vessel and the float means is arranged to delay the motion of said float means with respect to said liquid within said vessel over at least part of the range of motion of the float means.

Said float means may be situated within a or the second vessel. Said fluidic oscillator may further comprise means of permitting a flow of liquid between the said first vessel and said second vessel wherein said flow may be driven by the hydrostatic pressure difference at the bottom each said vessel, due to the liquid therein. Said means of permitting a flow of liquid may further comprise a viscous drag intended to give rise to a phase shift between the liquid levels in said first and second vessels or otherwise.

Said float means may be free to move substantially free from impedance due to mechanical friction in the mid range of the trajectory thereof, such that said float means gives rise to switching between high and low pressure reservoirs only when it is substantially high or low so as to cause hysteresis.

Said high pressure reservoir may contain a gas. The gas may be compressed air.

At least one of the dissipative processes which may give rise to a time delay in combination with a capacitive process may be due to the said load. The dissipative processes giving rise to a time delay may comprise thermal resistance.

Said load may be located between either of the first or second vessels to which it is coupled and another vessel which is arranged to provide load compliance.

Said means of communicating the volume of working fluid within said fluidic oscillator to the means of giving rise to pressure changes may involve the pressure or volume of said working fluid within said load compliance.

Said load compliance may comprise a second fluidic machine such as a fluidic heat pump substantially of the same type or otherwise. Said second fluidic machine may comprise a fluidic oscillator arranged to operate in antiphase with respect to the first fluidic oscillator.

According to a still further aspect of the present invention there is provided an oscillating thermofluidic heat engine or heat pump comprising a fluidic oscillator, and further comprising:

a. First and second vessels arranged to contain a working fluid;

b. Means of conjoining said two vessels so as to subject them to a common pressure;

c. Means of coupling the working fluid in the first vessel to a load such that changes in the volume of working fluid contained in said first and second vessels give rise to transfer of work between said first vessel and the load;

d. Means of communicating the volume of working fluid contained within said first vessel to the second vessel;

e. Heat exchanger means located substantially within said second vessel intended to give rise to pressure changes in the working fluid by heating or cooling of part thereof;

f. Two or more time delay mechanisms arranged to give rise to a phase shift between the volume of working fluid contained within said first vessel and said pressure changes therein, said time delay mechanisms each comprising a dissipative process and a capacitive process wherein at least one of said time delay mechanisms comprises the thermal resistance of said heat exchangers and the compressibility of the working fluid and at least one of the time delay mechanisms comprises any of the following: viscous drag, hydrostatic pressure change due to flow, thermal resistance, fluid compressibility, thermal capacitance, friction or elasticity;

g. Thermal reservoirs having a temperature difference therebetween coupled to said heat exchanger means such that the temperature difference within the heat exchangers gives rise to the magnitude of said pressure changes in the working fluid increasing or remaining constant with time.

According to a yet further aspect of the present invention there is provided an oscillating thermofluidic heat engine or heat pump comprising a fluidic oscillator, and further comprising:

a. First and second vessels arranged to contain a working fluid which is part liquid and part vapour within the vessels;
b. Means of cojoining said two vessels so as to subject them to a common pressure;
c. Means of coupling said working fluid to a load comprising a liquid such that changes in the volume of working fluid contained within said first and second vessels give rise to displacement of said liquid and transfer of work between said first vessel and the load;
d. Means of permitting a flow of liquid between the first vessel and the second vessel driven by the hydrostatic pressure difference at a lower portion of each said vessel due to the liquid therein;
e. Heat exchanger means located substantially within said second vessel intended to heat and thereby expand part of said working fluid when liquid level is high therein and cool and thereby contract part of said working fluid when liquid level is low therein;
f. A time delay mechanism comprising the viscous drag arising from said flow of liquid between said first and second vessels and the change in hydrostatic pressure therein, said time delay mechanism giving rise to a phase difference between the liquid levels in said two vessels;
g. A second time delay mechanism comprising the thermal resistance arising due to said heat exchanger means and the compressibility of the working fluid, said second time delay mechanism giving rise to a phase shift between the liquid level in said second vessel and the pressure of said working fluid;
h. Thermal reservoirs having a temperature difference therebetween coupled to said heat exchanger means such that the temperature difference within the heat exchangers gives rise to the magnitude of said pressure changes in the working fluid increasing or remaining constant.

In the aspects of the present invention that comprise a thermofluidic heat engine or heat pump, the thermofluidic heat engine or heat pump may further comprise the optional features described hereinafter.

In the aspects of the invention in which high or low pressure reservoirs are provided, said high pressure reservoir may comprise heat exchanger means arranged to give rise to heating of working fluid therein. Said low pressure reservoir may comprise heat exchanger means arranged to give rise to cooling of working fluid therein.

In all aspects of the invention that comprise heat exchanger means said heat exchanger means may be arranged to give rise to alternate evaporation and condensation of the said working fluid. Said hot and cold heat exchange means may be located in separate vessels or separate chambers within the same vessel. A hot heat exchanger may be located within a first chamber parallel to a second chamber in which a cold exchanger is located. Said thermofluidic oscillator may comprise regenerator or recuperator means. One of said dissipative process giving rise to a time delay may be thermal resistance.

All aspects of the invention that comprise a fluidic oscillator, a thermofluidic heat engine or a thermofluidic heat pump may further comprise the optional features described hereinafter.

The vessel, or first said vessel may be substantially greater in height than in width and waisted towards the centre thereof. A float in addition to any existing float means may be provided within said vessel containing working fluid coupled to said load. Said float in addition to any existing float means may be arranged to rest on top of said liquid such that thermal or other losses are reduced. A second liquid in addition to any existing liquid may be provided within said vessel containing working fluid coupled to said load. Said second liquid may be substantially immiscible therewith. Said second liquid may have a lower density than existing liquid therein so that it floats on top thereof, such that thermal or other losses are reduced, or ideally minimised. The vertical axes of the first and second chambers may be parallel.

Said working fluid may comprise two or more components. One or more of said components may be arranged to be active in giving rise to pressure changes in the working fluid. One or more of said components may be interspersed throughout said fluidic oscillator. One or more of said components may be passive and mainly occupy said vessel from which working fluid is coupled to a load so as to impede active components of said working fluid from entering therein.

An additional chamber may be situated between said means of giving rise to pressure changes and the one of the first or second vessels from which working fluid is coupled to a load. Said additional chamber may be arranged to separate, at least substantially completely, by diffusion, gravity or other means passive components from active components of said working fluid.

A flexible bag, diaphragm, membrane or other flow separation means may be located between said means of giving rise to pressure changes and said vessel or first vessel connected to said load.

An additional hydraulic or pneumatic work transfer fluid may be situated between said working fluid and said load such that said working fluid is substantially immiscible with said work transfer fluid and means of retaining a stable interface between said working fluid and said work transfer fluid are arranged.

A flexible bag, diaphragm, membrane or other flow separation means may be located between said vessel from which working fluid is coupled to a load and said load, such that fluid in the vicinity of said load is unable to mix with fluid in the vicinity of said vessel from which working fluid is coupled to said load.

Said load may comprise one or more further fluidic machines such as a fluidic heat pump substantially of the same type or otherwise.

Said one or more further fluidic machines may each comprise a fluidic oscillator substantially of the same type as said first fluidic oscillator or otherwise, and preferably being arranged to have a phase difference therebetween.

Said one or more other fluidic machines may each comprise a load. At least one said load may further comprise inter alia said first fluidic oscillator.

All aspects of the invention may comprise a pump, arranged to impart a velocity to a fluid to be pumped.

In the aspects of the invention that comprise a pump, the pump may comprise a fluidic oscillator, a thermofluidic heat engine or heat pump. The fluidic oscillator, thermofluidic heat engine or heat pump may further comprise first and second thermal reservoirs having a temperature difference therebetween. The first thermal reservoir may comprise a solar collector. Said first thermal reservoir may comprise an output from a heating apparatus. Said heating apparatus may comprise a boiler arranged to circulate heating fluid about a heating system.

A thermo-siphon or a heat pipe may connect said first thermal reservoir to the fluidic oscillator, the heat engine or the heat pump. The second thermal reservoir may comprise the fluid to which the said pump is applied. Said second thermal reservoir may comprise a subterranean heat sink. Said second thermal reservoir may comprise a fluid inlet or return to a heating apparatus.

The invention will now be described, by way of example only, with reference to the accompanying drawings, in which.

Figure 1:
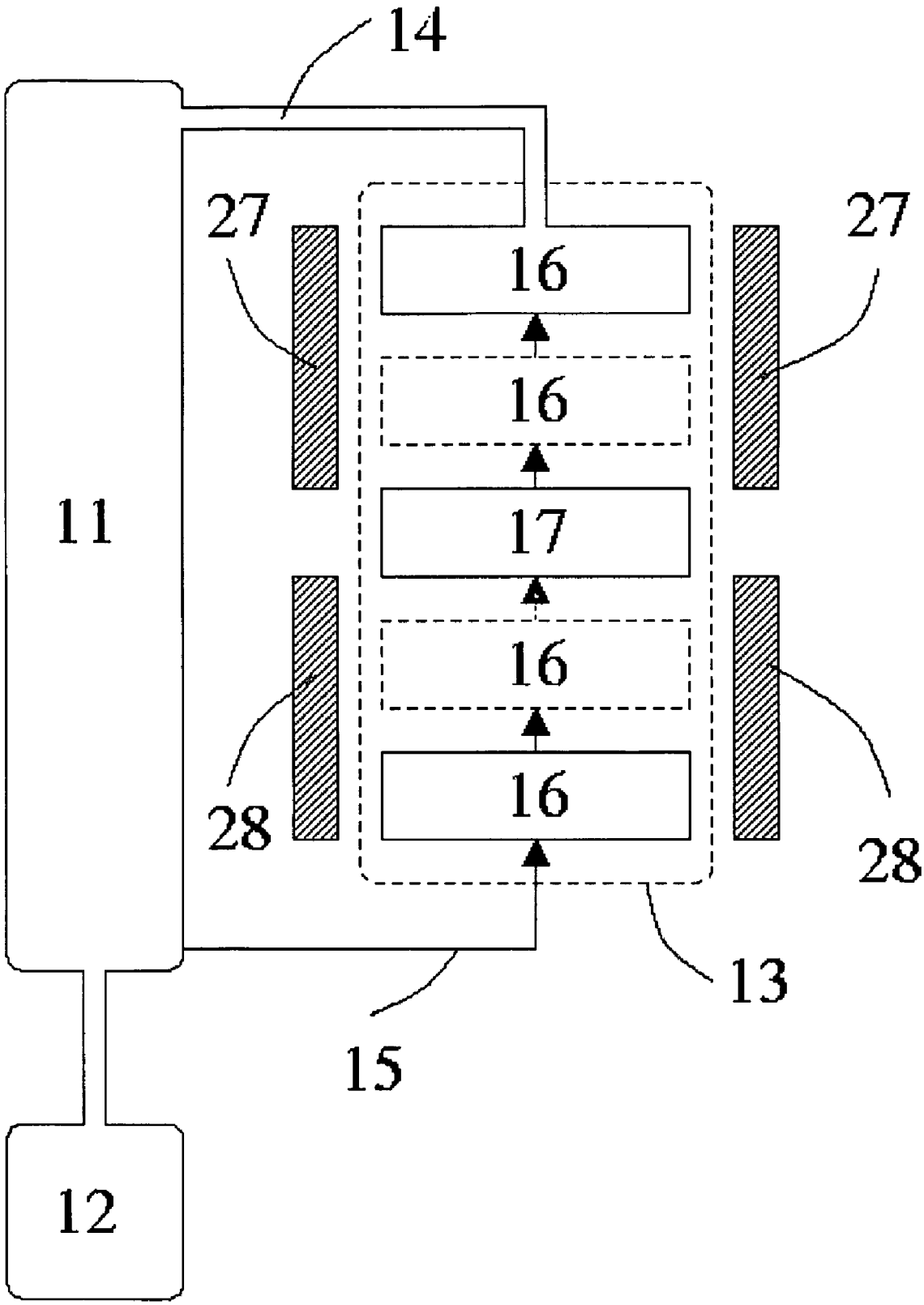
FIG. 1 is a schematic representation of an embodiment of a fluidic oscillator according to an aspect of the present invention.

Referring now to FIG. 1, a fluidic oscillator comprises first and second vessels 11,13 containing a working fluid, a connecting conduit 14, means, typically a pipe or conduit 15 of communicating the mass of working fluid in vessel 11 to vessel 13, a load 12, pressurising means 27, for example a hot heat exchanger or a source of pressurised gas, intended for raising the pressure within the vessels 11,13 and depressurising means 28, for example a cold heat exchanger or a pressure release mechanism, of lowering the pressure therein.

The conduit 14 connects the top of the first and second vessels 11,13 so as to subject them to a common pressure by coupling the working fluid in the two vessels 11,13.

The load 12 is connected to the working fluid within the first vessel 11 to enable changes in the mass of the working fluid in the two vessels 11,13 to give rise to a transfer of work between the first vessel 11 and the load 12.

The pressurising means 27 is arranged so that the pressure is caused to rise within the vessels 11,13 due to a flow of heat, or further working fluid into vessel 13 when the mass of working fluid within vessel 11 is large. The rise in pressure causes further working fluid to be forced out of the first vessel 11 through the load 12. The decreasing mass of working fluid in vessel 11 is communicated to vessel 13 by means 15. As the mass of working fluid in first vessel 11 decreases, vessel 13 is no longer subjected to means of pressurisation 27. When the mass of working fluid in first vessel 11 is sufficiently decreased, means 28 of depressurising the vessels 11,13 is applied to vessel 13 causing the pressure to fall within the vessels 11,13 due to a flow of heat or working fluid therefrom. The ensuing fall in pressure causes further working fluid to be sucked into vessel 11 through the load 12 and the process starts again.

Work is obtained from the load as the mass of working fluid in the two vessels fluctuates due to the flow of working fluid through the load and the pressure differential across the load.

Time delay mechanisms 16 associated with the working fluid are arranged to cause a phase shift between the mass of working fluid contained within first vessel 11 and the pressure changes therein. The time delay mechanisms each comprise a dissipative process, such as viscous drag, thermal resistance or mechanical friction, and a capacitive process, such as hydrostatic pressure change due to flow, fluid compressibility, thermal capacitance, or elasticity.

There is also at least one mechanism 17 associated with the working fluid that gives rise to a gain such that under normal operation, the magnitude of said pressure changes in the working fluid preferably increases or remains constant with time.

The nature of some of the dissipative and capacitive process at play in a fluidic oscillator according to the present invention will now be detailed.

Inertance (Inductance)

Consider an inviscid fluid flowing in a tube of constant radius. The rate of change in the mass flow rate $\dot{m}$ (c.f current) due to a pressure difference $\Delta P$ (c.f potential difference) over a distance l, parallel to the flow is:

$$\frac{d\dot{m}}{dt} = A\frac{\Delta P}{l}$$

So that if pressure is held analogous to voltage and current is held analogous to mass flow, the fluid inductance $$L = \frac{l}{A},$$

behaves in the same was as inductance in an electrical circuit.

For an incompressible fluid, mass flow rate is proportional to volumetric velocity, so the analogy holds equally well between pressure and volumetric velocity in the case of a liquid, but the inertance needs to account for density and thus becomes:

$$L = \frac{\rho l}{A}$$

Hydrostatic capacitance: For a flow of fluid into a vertically aligned chamber of cross section A, the rate of change of pressure P at the base is proportional to the flow in, i.e.:

$$\frac{dP}{dt} = \frac{\rho g U}{A} = \frac{\dot{m} g}{A}$$

So that if current is held analogous to mass flow, the hydrostatic capacitance is $$C = \frac{A}{g}$$

or if the analogy is between current and volumetric velocity, U:

$$C = \frac{A}{\rho g}$$

Compliance:

Consider a compressible fluid flowing into a closed volume, being forced into that volume by pressurised fluid from underneath/behind which may or may not be compressible itself.

The rate of change of pressure in that closed volume is related to the mass flow of fluid forcing it in from behind. If the volume is adiabatic and the compression is isentropic: $PV^{\gamma}$=const. where V is the volume of the closed volume, $\gamma$ is the ratio of the specific heats at constant pressure and constant volume.

Differentiating we have:

$$V^{\gamma}\frac{dP}{dt} + P\gamma V^{\gamma-1}\frac{dV}{dt} = 0$$

Such that, rearranging and dividing through by $V^{\gamma}$.

$$\frac{dP}{dt} = -\frac{\gamma P}{V}\frac{dV}{dt}$$

P and V are not constants however. Considering small changes:

$$(P_0 + dP) = \frac{P_0 V_0^{\gamma}}{(V_0 + dV)^{\gamma}} = \frac{P_0}{(1 + dV/V_0)^{\gamma}} \approx P_0\left(1 - \frac{\gamma dV}{V_0}\right)$$

So that to a first order approximation:

$$\frac{dP}{dt} = -\frac{\gamma P_0}{V_0}\frac{dV}{dt} = \frac{\gamma P_0}{V_0}U = \frac{\gamma P_0}{\rho V_0}\dot{m}$$

wherein isentropic fluid capacitance becomes:

$$C = \frac{V_0}{\gamma P_0}$$

if pressure is held analogous to voltage and current is held analogous to mass flow, or the 'isentropic compliance' becomes $$C = \frac{\rho V_0}{\gamma P_0}$$

if pressure is held analogous to voltage and current is held analogous to volumetric velocity. Similar analogies can be made for isothermal spaces, polytropic spaces and all sorts of boundary conditions.

Figure 2:
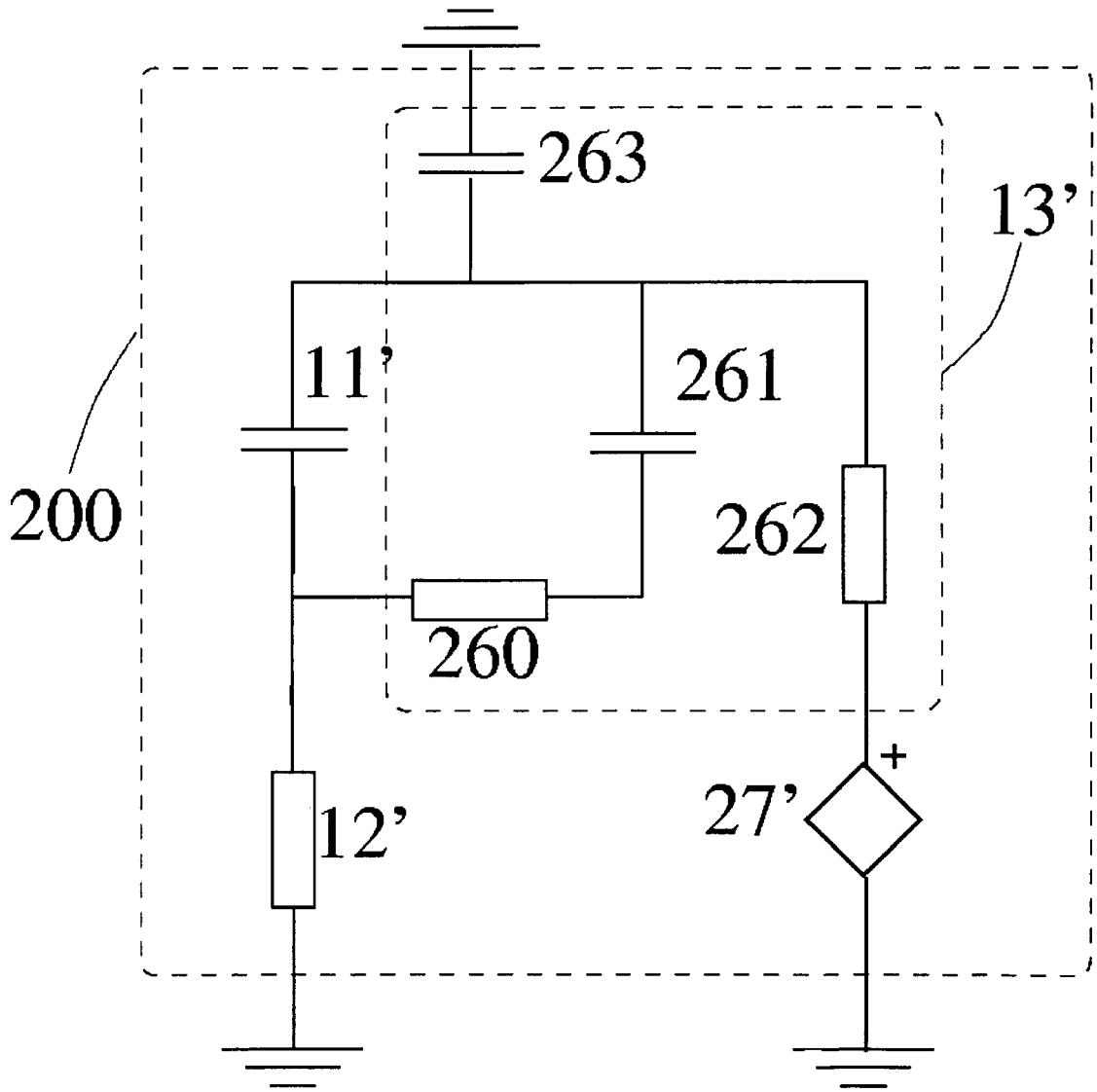
FIG. 2 is a diagram of an electrical circuit analogous to the fluidic oscillator of FIG. 1, in which the dissipative processes are represented by electrical resistors and the capacitive processes are represented by electrical capacitors.

Referring now to FIG. 2, an electrical circuit 200 analogous to the fluidic oscillator of FIG. 1 is shown. The load 12 is modelled as a resistor 12', and the first vessel 11 is modelled as a capacitor 11'. The second vessel 13 is modelled by the circuit denoted by 13', where the time delay mechanisms 16 comprise dissipative processes modelled as resistors 260, 262, and capacitive processes modelled as capacitors 261, 263. The voltage (pressure) source is analogous to pressure in the fluidic oscillator of FIG. 1 and is equal to the voltage across capacitance 261 (i.e.: hydrostatic pressure across vessel 13) multiplied by the gain. The means of pressurising and depressurising, 27 and 28 are modelled as a variable voltage source 27', the value of the voltage being linked to the pressure across capacitance 261.

Figure 3:
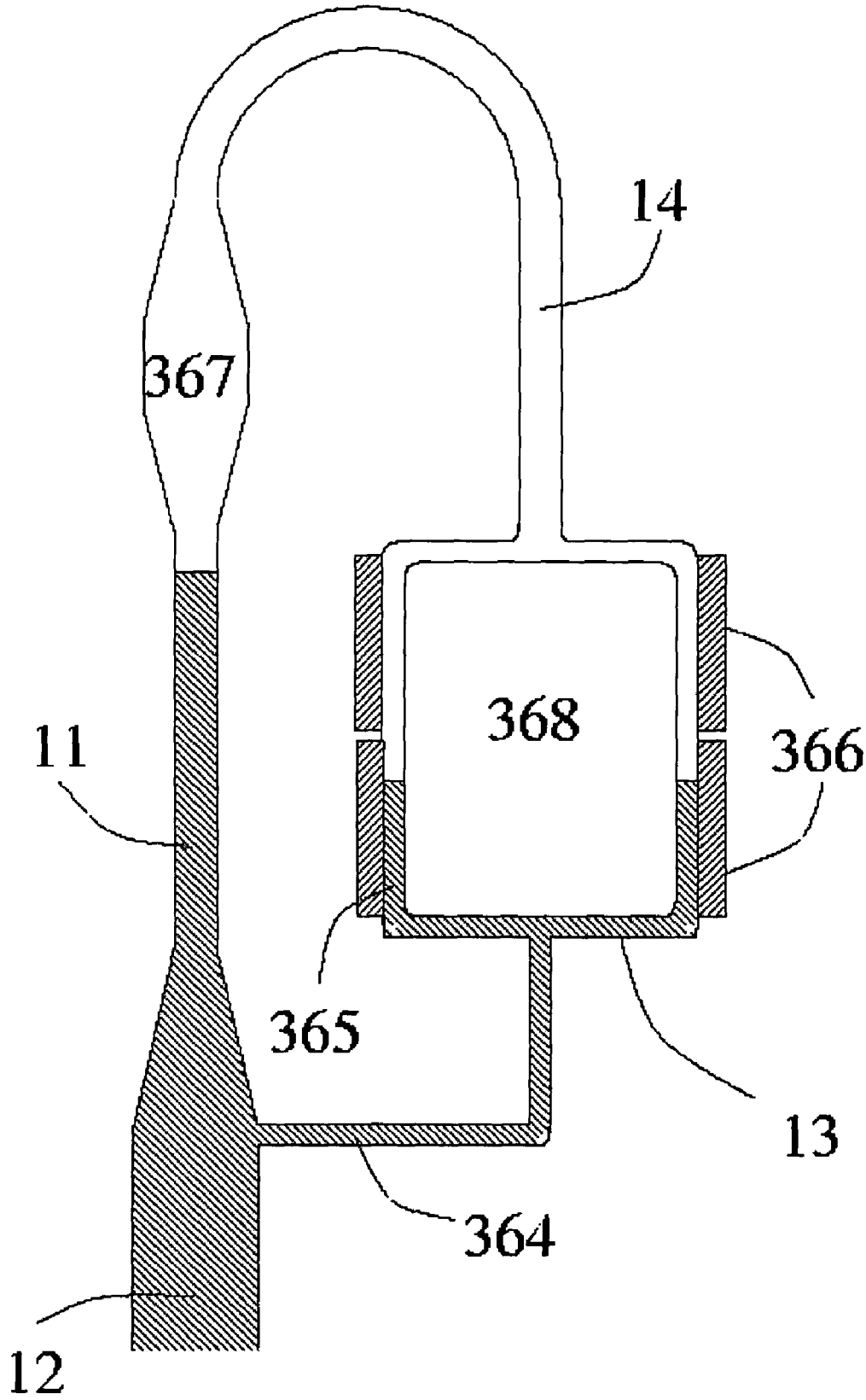
FIG. 3 shows a heat engine incorporating an embodiment of a thermofluidic oscillator according to an aspect of the present invention.

Referring now to FIG. 3, the fluidic oscillator is a heat engine embodiment of the fluidic oscillator described with reference to FIG. 1 or 'thermofluidic' oscillator. Common components will be accorded the same reference numerals. The working fluid is part vapour and part liquid within the first and second vessels 11,13. The vapour is free to flow between the vessels 11,13 via the conduit 14. The liquid passes between the vessels through the restriction, or throttle, 364 wherein the flow rate of liquid is determined by the difference in the hydrostatic pressure of the liquid 365 at the respective bases of the first and second vessels 11,13.

The second vessel 13 is provided with heat exchangers 366 giving rise to a flow of heat into vessel 13 when the liquid level is high and flow of heat therefrom when the liquid level is low therein, the flow of heat permits alternate evaporating and condensing. The evaporation and condensation of the fluid within vessel 13 causes pressure changes within the vessels 11,13. The rate of change of pressure within the vessels 11,13 is determined, amongst other factors, by the volume of the conduit 14, the volume of any dead space in vessels 11,13, thermal resistance due to the heat exchangers 366 and the volume of a saturator 367.

The purpose of the saturator 367 is not normally to add extra compliance, which should generally be minimised, but rather to provide a reservoir for the liquid piston to fill should its amplitude be very large under certain running conditions. The term saturator is used, because it causes the hydrostatic pressure to saturate in the power cylinder, i.e. once the liquid starts filling the reservoir, hydrostatic pressure is substantially invariant due to the large cross sectional area of the reservoir.

The changes in the pressure of the working fluid give rise to displacement of liquid in vessel 11 through the load 12 such that a 'load phase shift' between said pressure changes and said displacement arises due to dissipation within the load. Under normal operating conditions, the load phase shift is matched by a 'feedback phase shift' between the displacement of liquid in vessel 11 and the vapour pressure therein. The feedback phase shift is due to, inter alia, the viscous drag in restriction 364, the thermal resistance due to heat exchangers 366 and the rate of change of hydrostatic pressure due to hydrostatic capacitance 365 and the compressibility of the working fluid in 14 and 367 due to the compliance therein.

Ideally, the load phase shift is related to the feedback phase shift such that the phase shifts normally have equal magnitude being close to 90°. Furthermore, the total phase shift between the flow of heat through heat exchangers 366 and the saturation temperature in vessel 13 is ideally close to the value required to give the maximum difference between mean heat addition and heat rejection temperatures for a given pressure amplitude.

The first vessel 11 is preferably significantly narrower in the centre region than at the ends thereof which are joined to the load 12 and saturator 367. The total compliance contained within saturator 367 and conduit 14, is preferably minimised.

The load is preferably arranged to comprise inertance with reactive impedance having a magnitude equal to that of the compliance contained within saturator 367 and conduit 14 at the frequency of the oscillations.

The cross sectional area of the second vessel 13 in the centre section is usually minimised within limits set by the surface tension of the working fluid. The ideal ratio of the cross sectional area of the first vessel 11 in the centre section to the cross sectional area of the second vessel 13 is determined by a trade off between heat exchanger coverage with the thermal phase angle and the load phase angle and various loss mechanisms, usually including undesired cyclic transfer of heat to and from the walls of vessel 11, and viscous drag in vessel 11. The ideal ratio is typically, although not necessarily between 1:2 and 2:1. The second vessel 13 is typically provided with an annular insulator 368 or other means of maximising the area of the heat exchanger available to effect heat exchange within the vessel 13.

Figure 4:
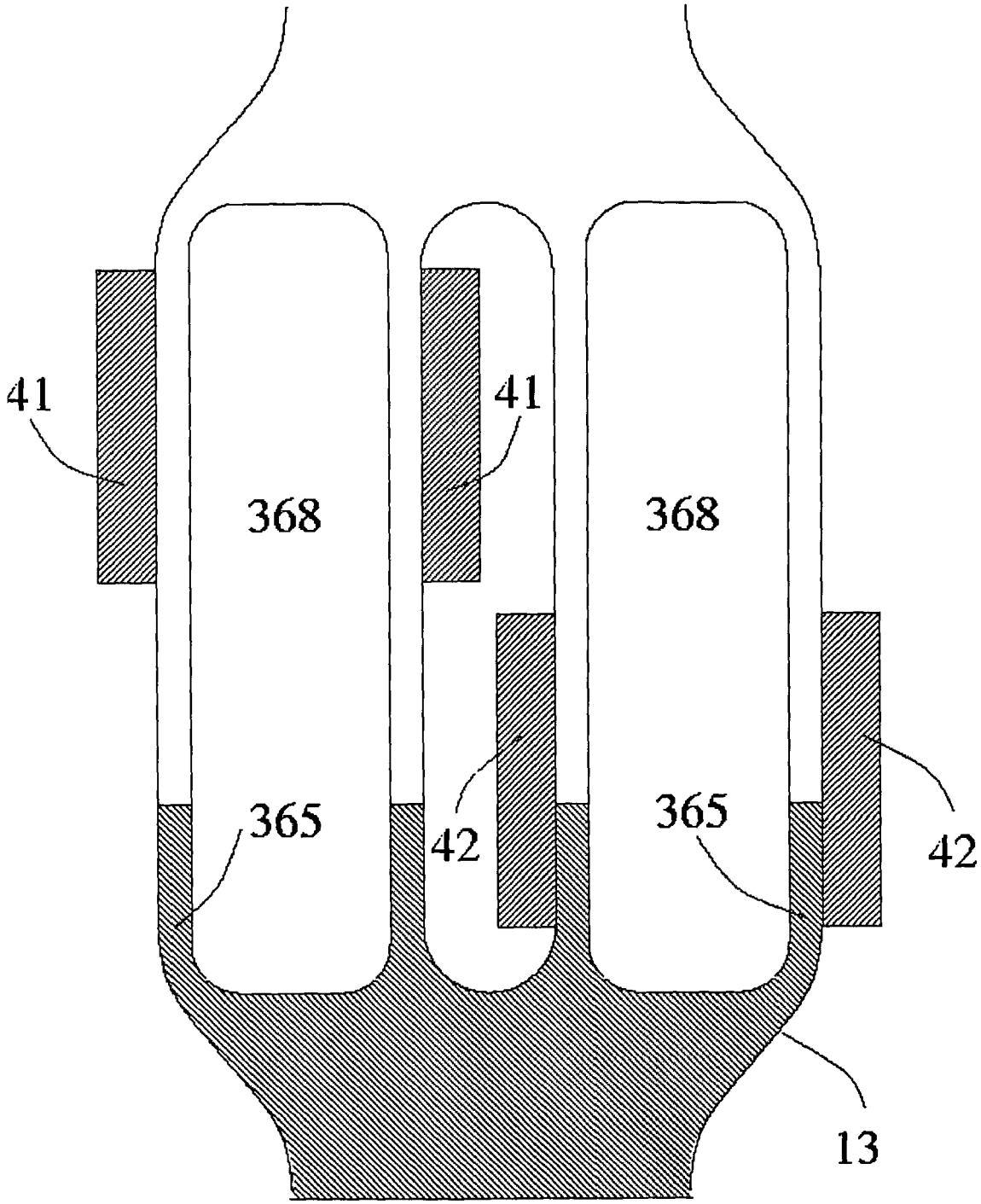
FIG. 4 is a representation of a heat engine, incorporating an embodiment of a thermofluidic oscillator according to an aspect of the present invention, in which the heat exchangers giving rise to a thermal resistance are arranged in separate chambers.

Referring to FIG. 4, the fluidic oscillator is similar to that described with reference to FIG. 3 and common components will be accorded the same reference numerals. The second vessel 13 is arranged in two parts side by side, one containing a hot heat exchanger 41 and the other containing a cold heat exchanger 42. Ideally this arrangement minimises oscillatory heat transfer to and from said liquid and vapour not giving rise to evaporating or condensing thereof, thereby optimising the efficiency of the heat exchanger.

Figure 5:
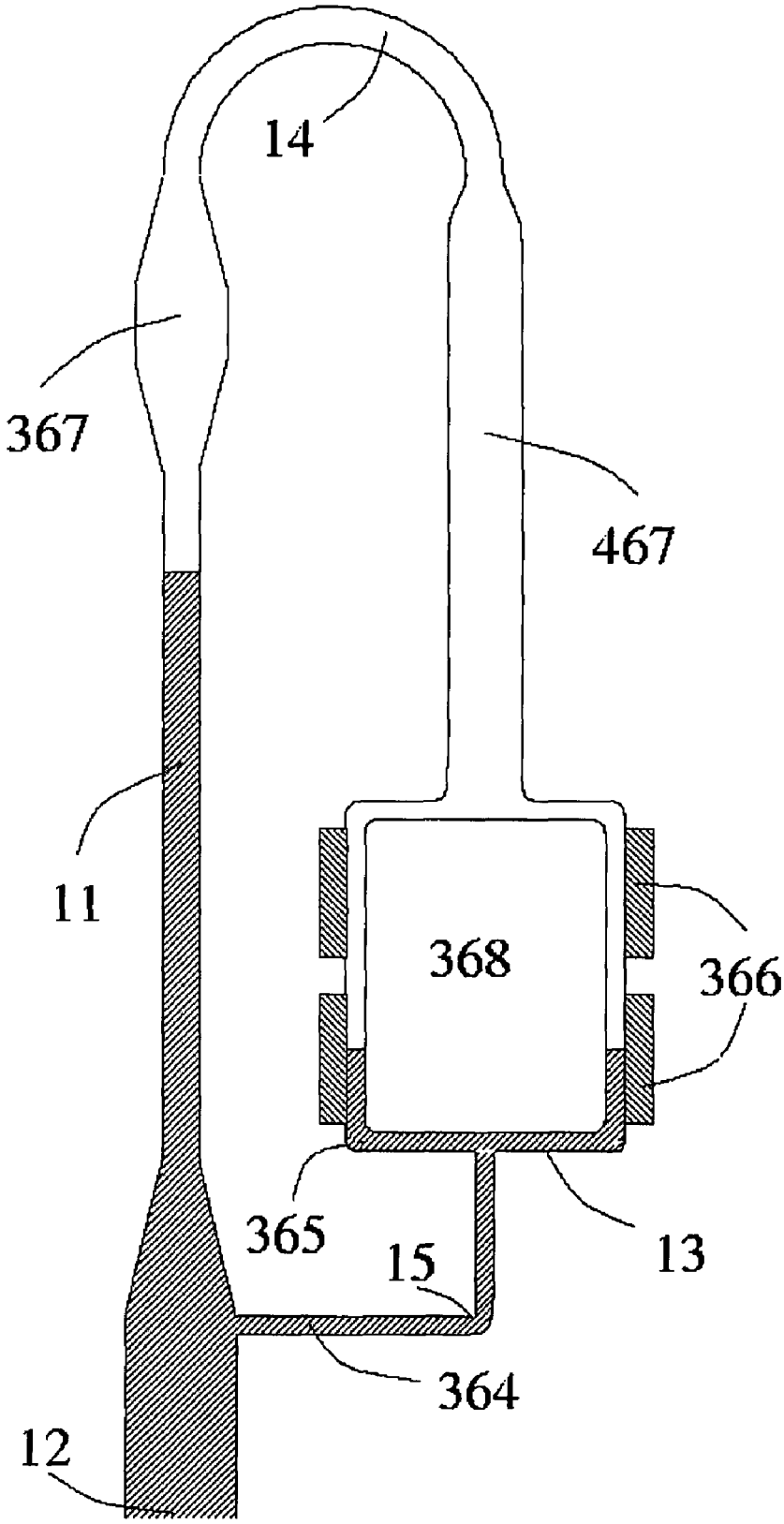
FIG. 5 is a representation of a heat engine, incorporating an embodiment of a thermofluidic oscillator according to an aspect of the present invention, comprising a passive component in a working fluid and a diffusion region is included.

Referring now to FIG. 5, a quantity of passive gas and a diffusion column 467 are added to the working fluid such that the passive gas is situated substantially within the saturator 367, the conduit 14, and the upper region of the diffusion column 467, whilst the vapour mainly occupies the second vessel 13 and the lower region of the diffusion column 467. The passive gas is intended to limit cyclic transfer of heat to and from the first vessel 11 and the working fluid contained therein.

It is understood that diffusion column 467 will add further compliance to that of the saturator 367 and the conduit 14, with an effect on the performance of the embodiment which must be accounted for in design calculations. Typical negative effects include a drop in frequency, a lower difference between mean heat addition and rejection temperatures and higher exergy, or available work dissipation in heat exchangers and typical positive effects of the additional compliance include an improvement in stability and the ability of the fluidic oscillator to self-start.

Figure 6:
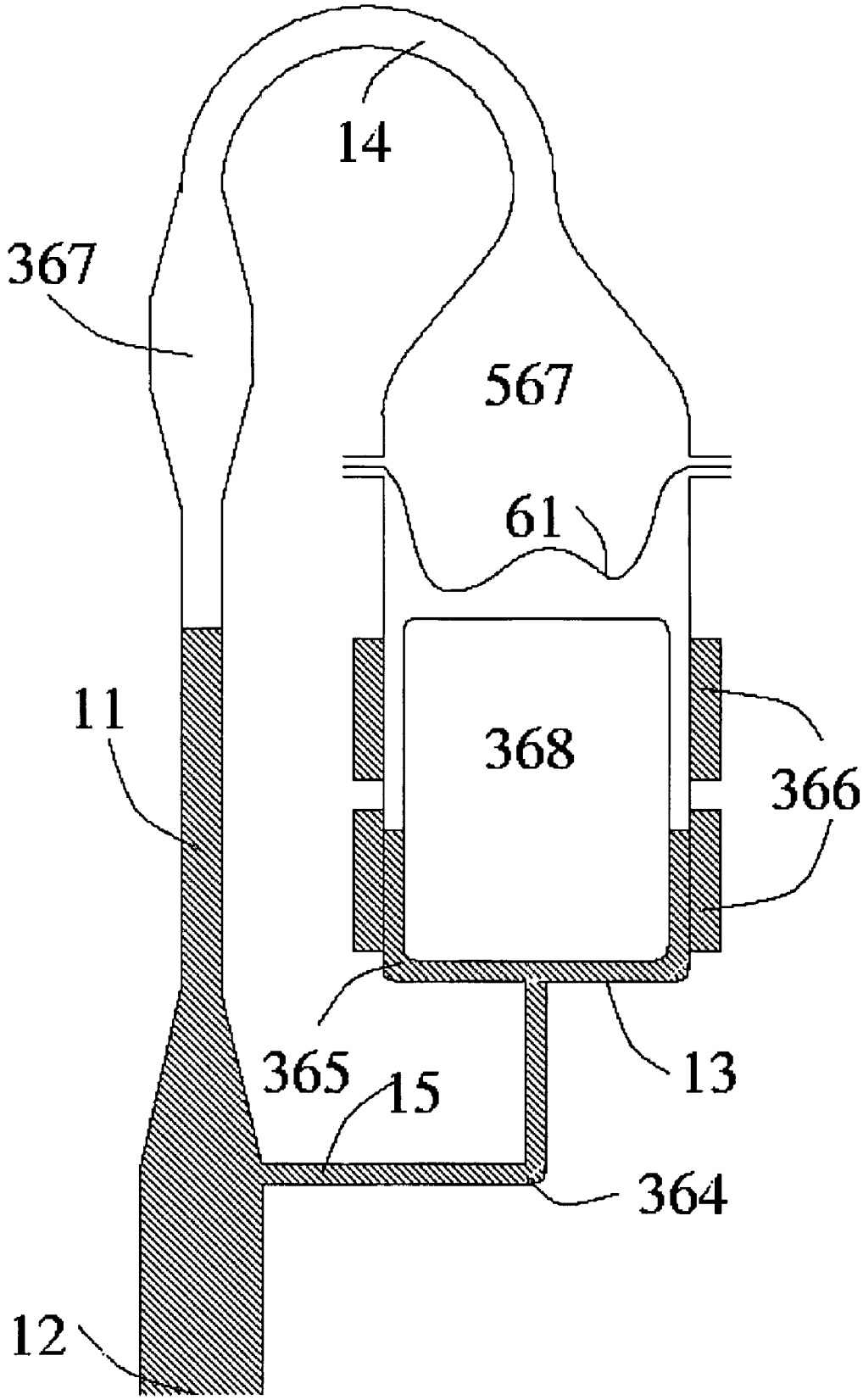
FIG. 6 is a representation of a heat engine, incorporating an embodiment of a thermofluidic oscillator according to an aspect of the present invention, in which a membrane, diaphragm or other obturator means separates an active component of a working fluid from a passive component thereof.

Referring now to FIG. 6, the fluidic oscillator is similar to that described with reference to FIG. 1 and common components will be accorded the same reference numerals. The diffusion column of FIG. 4 is replaced by a separation chamber 567 intended to prevent mixing of said passive gas situated substantially within the saturator 367, the conduit 14 and the upper part of the separation chamber 567, with said vapour which mainly occupies the second vessel 13 and the lower part of the separation chamber 567. A flexible bag, diaphragm, bellows or other suitable fluid separator 61 is located within the separation chamber 567 to limit cyclic transfer of heat to and from the first vessel 11 and the working fluid contained therein.

The main advantage of a fluid separator over a diffusion column is that a separation chamber may be arranged to have substantially less volume than a diffusion column, lowering the compliance therein and the negative effects associated therewith. This is possible because there is a much sharper concentration gradient across the fluid separator than can exist due to diffusion alone as diffusion is no longer the process which limits the mixing of gas and vapour. The main disadvantage of a fluid separator is that it is liable to rupture due to mechanical stress or fatigue.

Working fluid can be supplied to the second vessel 13 by a high pressure reservoir, typically an evaporator, and removed by a low pressure reservoir, typically a condenser. However, it will be understood that the high and low pressure working fluid reservoirs can be provided by means other than an evaporator or condenser, for example, an air compressor, or a vacuum pump.

Figure 7:
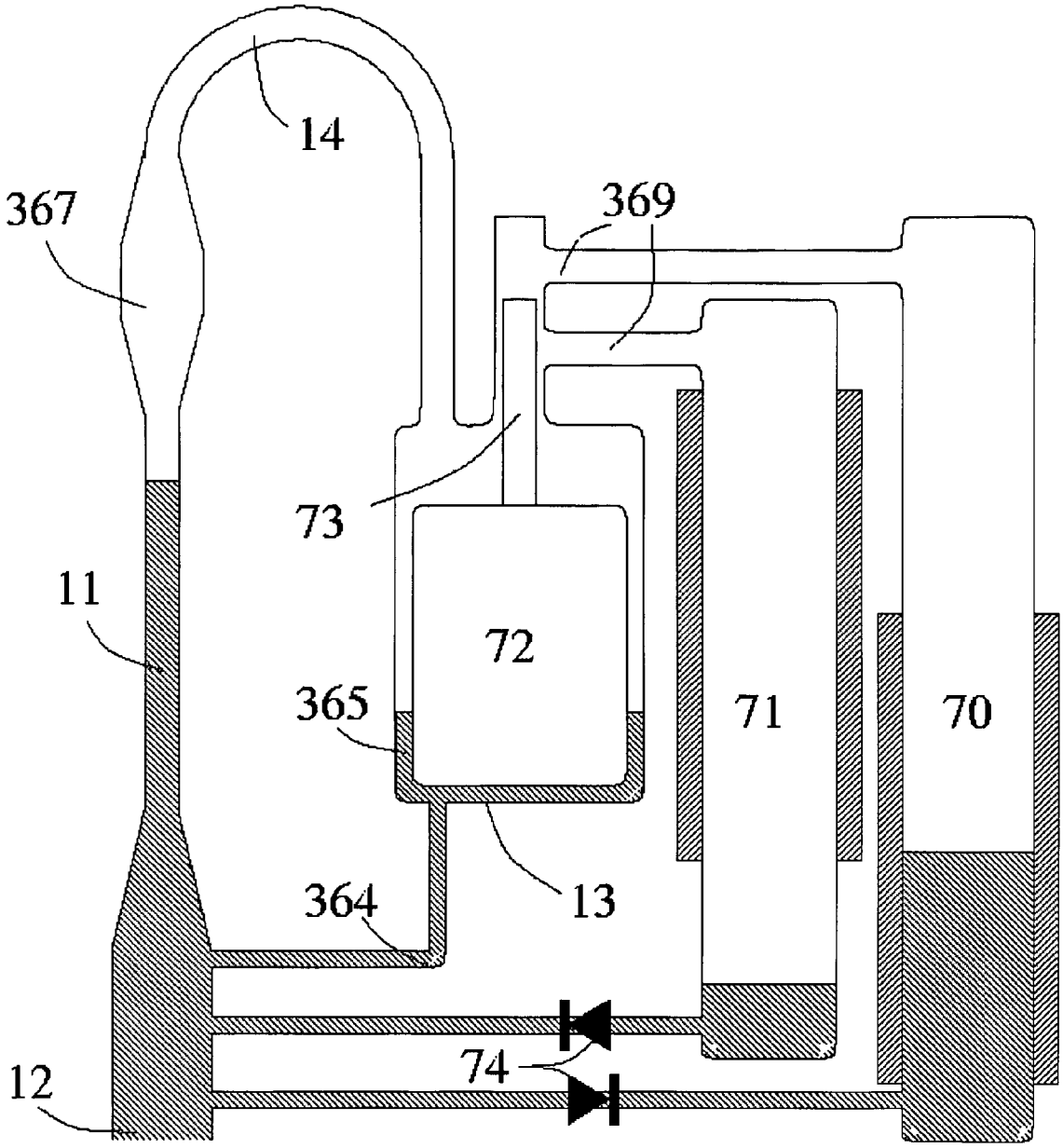
FIG. 7 is a representation of a pump, incorporating an embodiment of a fluidic oscillator according to an aspect of the present invention, in which pressurisation and depressurisation means are separated into additional vessels which are in selective communication with a central chamber by means of a float actuated valve.

Referring now to FIG. 7, the second vessel 13 is supplied with a float 72 intended to actuate a valve 73 such that the high pressure reservoir 70 is in fluid communication with vessel 13 when the float 72 is high in the vessel 13 and low pressure reservoir 71 is in fluid communication with vessel 13 when the float 72 is low therein. The time varying flow of working fluid between vessel 13 and pressure reservoirs 70,71 gives rise to pressure changes within the vessels 11,13, wherein the rate of change of pressure is determined by, inter alia, the volume of conduit 14, the dead space in vessels 11 and 13, the viscous drag due to conduits 369 and the saturator 367.

The changes in the pressure of the working fluid give rise to displacement of liquid in vessel 11 through the load 12 such that a 'load phase shift' between said pressure changes and said displacement arises due to dissipation within the load. Under normal operating conditions, the load phase shift is matched by a 'feedback phase shift' between the displacement of liquid in vessel 11 and the vapour pressure therein. The feedback phase shift is due to, inter alia, the dissipation in restriction 364 and conduits 369 and the capacitance or compliance in hydrostatic pressure changes 365 and compressibility of working fluid in the saturator 367.

Ideally, the load phase shift is related to the feedback phase shift such that the phase shifts normally have equal magnitude being close to 90°.

In the case that high pressure reservoir 70 is an evaporator and low pressure reservoir 71 is a condenser, it is desirable to provide a means of replenishing pressure reservoir 70 with liquid and removing liquid from pressure reservoir 71. This can be achieved by inserting feed-conduits between the base of vessel 11 and the said pressure reservoirs. It is desirable to add non-return valves 74 to the feed-conduits, preferably having a low cracking pressure so that a flow of liquid can be induced between the base of vessel 11 and the said pressure reservoirs by the hydrostatic pressure difference therein.

A similar arrangement can be conceived of in the case that the embodiment is a heat engine in which the working fluid does not undergo a phase change, wherein the replenishment of working fluid to the hot and cold heat exchange means is provided for by diverting work from the load.

Figure 8:
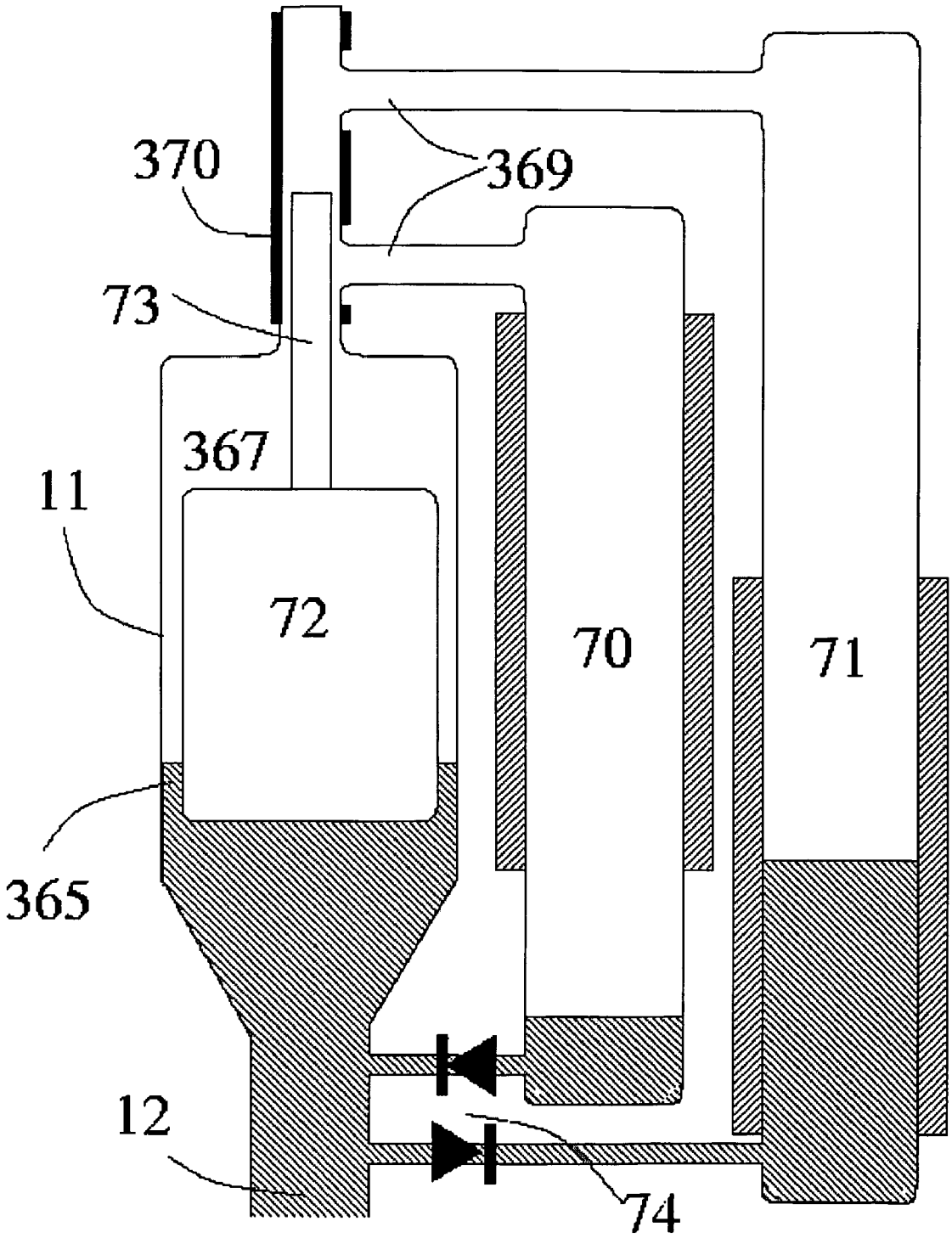
FIG. 8 shows an alternative arrangement of the pump of FIG. 7.

Instead of arranging the embodiment in FIG. 7 to comprise two separate working vessels, it may be desirable to eliminate said second vessel 13 as shown in FIG. 8. It is understood that the embodiment of the invention shown in FIG. 8 functions substantially as the embodiment shown in FIG. 7 except that the phase shift between the volume of liquid in the vessel 11 and the pressure of the working fluid therein is generated in different manner. In the embodiment of FIG. 8, the valve 73 has means of giving rise to a predetermined actuation force, for example friction between the valve seals and body 370 enabling a phase shift between the height of the float and the liquid level within vessel 11.

The changes in the pressure of the working fluid give rise to displacement of liquid in vessel 11 through the load 12 such that a load phase shift between the displacement and said pressure changes arises due to dissipation within the load. Under normal operating conditions, the load phase shift is matched by a 'feedback phase shift' between the displacement of liquid in vessel 11 and the pressure therein. The feedback phase shift is due to, inter alia, the means of giving rise to a pre determined actuation force 370, the viscous drag or dynamic pressure loss due to conduits 369, the capacitance or compliance in hydrostatic pressure changes 365 and compressibility of working fluid in the compliance 367.

Figure 9:
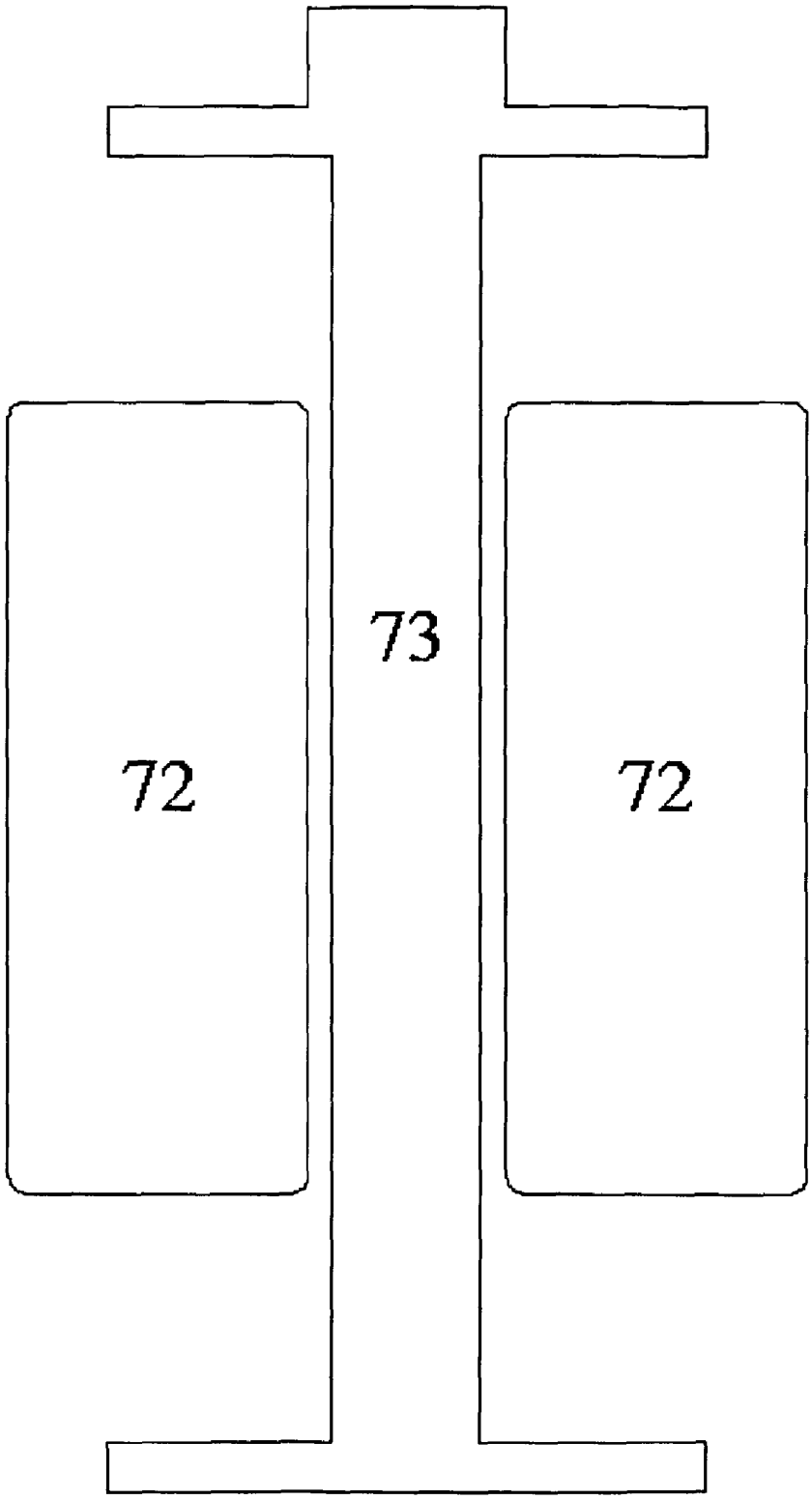
FIG. 9 shows a means of adding hysteresis to the float of FIGS. 7 and 8.

In the embodiments of the invention described in relation to FIGS. 7 and 8, it is generally desirable to generate hysteresis in the actuation of said valve means 73 by separating the float 72 from the valve means in accordance with the embodiment shown in FIG. 9.

Figure 10:
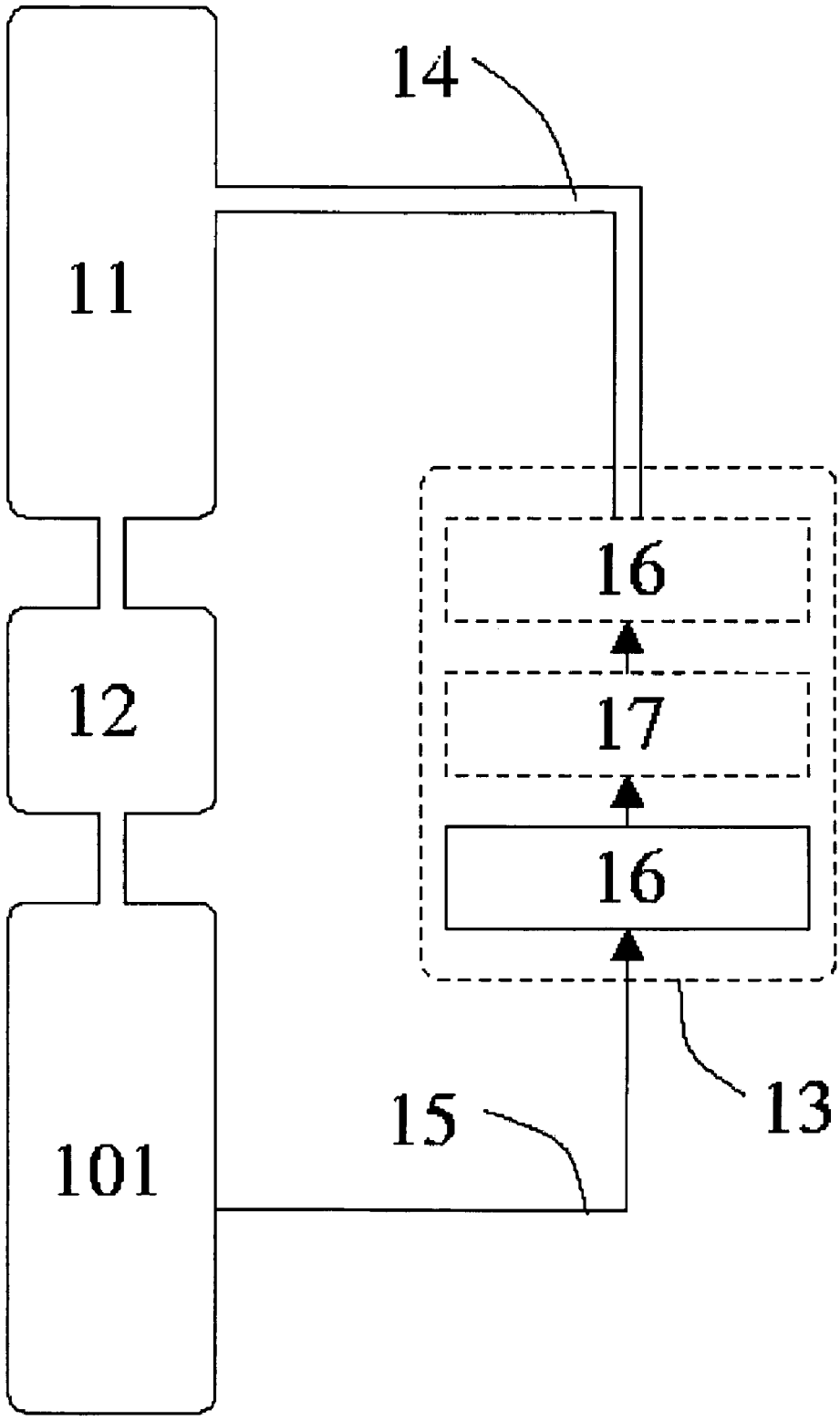
FIG. 10 is a representation of a heat engine, incorporating an embodiment of a thermofluidic oscillator according to an aspect of the present invention, in which one dissipative process is nominal thermal resistance of a fluid and heat exchanger components and another is a load.

In another embodiment of the invention described in relation to FIG. 10, the invention is embodied into another heat engine. In the embodiment of the invention in FIG. 10, one dissipative process contributing to the feedback phase angle comprises the dissipation of work within the load due to the pressure difference across the load and the flow of fluid therethrough. The loss of work to the load behaves as the loss of work in a viscous drag or the loss of available work through a thermal resistor. The first vessel 11 is connected to the second vessel 13 by a conduit 14 such that the first and second vessels 11,13 contain working fluid at a common pressure.

The first vessel 11 is connected to the load 12 such that changes in the mass of working fluid contained within first and second vessels 11,13 give rise to a displacement of fluid between the vessels 11,13 and the load 12. A compliant vessel 101 is connected to the opposite side of the load 12 to said first vessel 11. Displacement of fluid between the first vessel 11 and the load 12 gives rise to the displacement of additional fluid between the load and the compliant vessel 101 such that a phase shift exists between the mass of working fluid contained within the vessels 11, 13 and the conduit 14, and the pressure of fluid contained within the compliant vessel 101. Means 15 of communicating the pressure contained within the compliant vessel 101 to the second vessel 13 is provided.

The second vessel 13 is provided with time delay mechanisms 16, each comprising a dissipative process and a capacitive process. The processes that constitute the time delay mechanism might for example include the dissipation of exergy, or available work due to a thermal resistance, or a viscous drag and thermal capacitance or compliance due to fluid compressibility. Ideally, the total phase shift between the displacement of working fluid between the load 12 and the first vessel 11 and the pressure therein is determined by the dissipation in the load, the compliance of vessel 101, the time delay mechanism 16 and the compliance of vessel 11 and conduit 14. It will be appreciated that the time delay mechanisms 16 may be replaced by other means of giving rise to an RC time delay such as a pressure sensor going through an amplifier and electrical RC circuit connected to a compressor in communication with the compliant vessel 101.

It will be understood that means of giving rise to a gain is provided such that the amplitude of pressure oscillations within vessels 11, 13 and the conduit 14 is greater than the amplitude of pressure oscillations within vessel 101 such that oscillation amplitude remains substantially constant with time under normal operating conditions.

Figure 11:
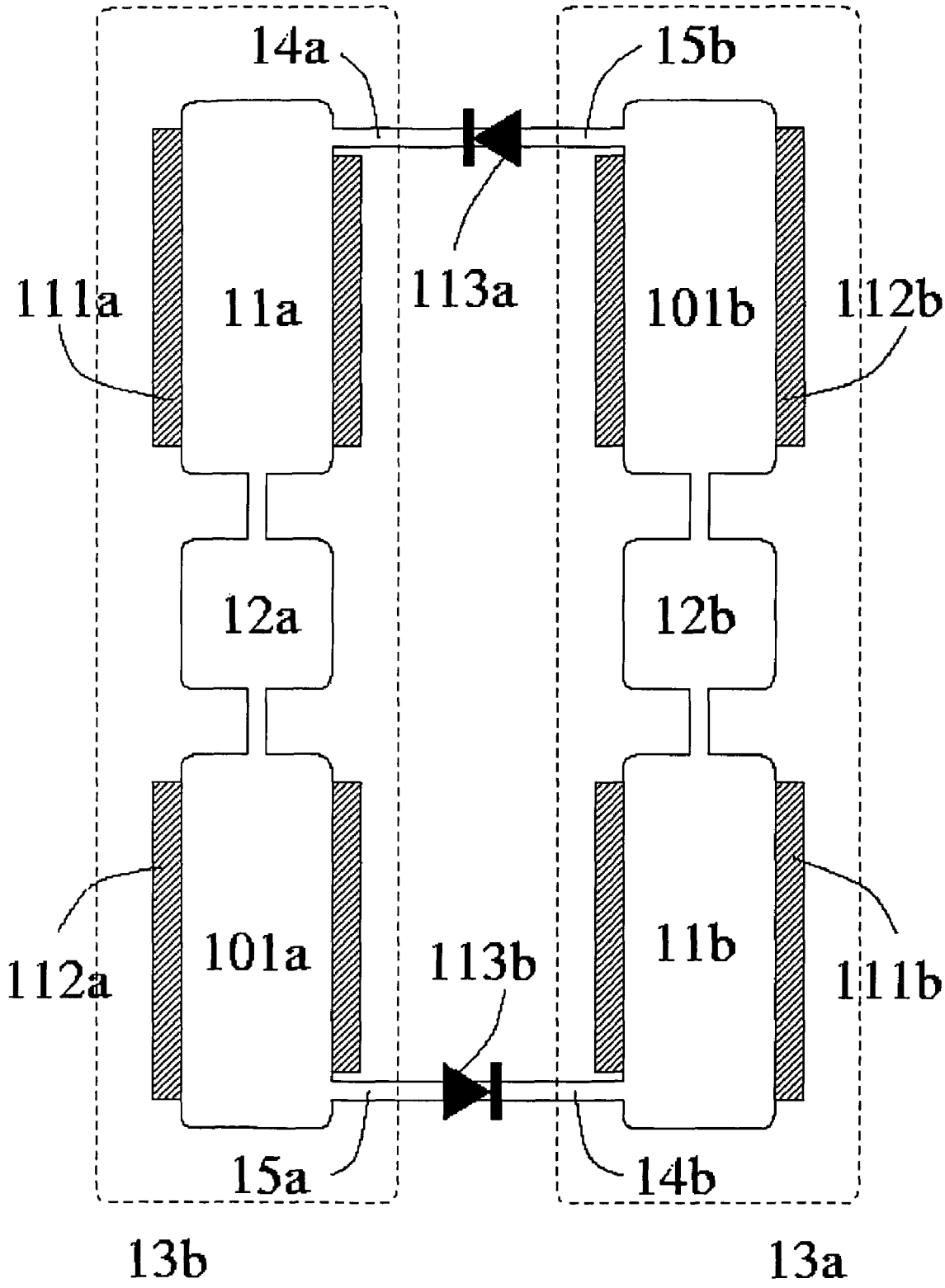
FIG. 11 shows a specific arrangement of the heat engine of FIG. 10.

A specific arrangement of the embodiment described in FIG. 10, in which non-return valves are provided with the intention that fluid flows in a single direction is shown in FIG. 11. Referring now to FIG. 11, a compliant sub-vessel 11*a* is connected to a second vessel 13*a*, which comprises more than one chamber, by means of conduit 14*a*. The conduit 14*a* is provided with a non-return valve 113*a* such that working fluid flows from the second vessel 13*a* to said compliant sub-vessel 11*a* when the pressure is greater within the second vessel 13*a* than the pressure in the compliant sub-vessel 11*a*.

The compliant sub-vessel 11*a* is provided with heat exchanger means giving rise to heating of working fluid entering from said second vessel 13*a*, and a consequential rise in pressure within the compliant sub-vessel 11*a*. The rise in pressure in the compliant sub-vessel 11*a* further gives rise to a flow of working fluid through a load 12*a* into a second compliant sub-vessel 101*a*. The flow of fluid into the compliant sub-vessel 101*a* results in a pressure increase therein. The second compliant sub-vessel 101*a* is provided with a heat exchanger 112*a* that cools the working fluid entering the second compliant sub-vessel 101*a* from the load 12*a*. A pressure increase in second compliant sub-vessel 101*a* is communicated to vessel 13*a* by a flow of cool working fluid, via a return conduit 15*a*.

The vessel 13*a* comprises an identical set of components to those already herein described comprising a sub-vessel 11*b*, a load 12*b*, a vessel 13*b*, means 14*b* of conjoining the sub-vessel 11*b* and the vessel 13*b*, a non-return valve 113*b*, heat exchanger means 111*b* and 112*b*, means of communicating the pressure within second compliant sub-vessel 101*b* to the vessel 13*b*, and a return conduit 15*b*. Vessels 13*a* and 13*b* comprise time delay means wherein said time delay is caused by the thermal resistance in heat exchangers 111*a*, 111*b*, 112*a* and 112*b*, the compressibility of the working fluid in sub-vessels 11*a*, 11*b* and the said conduits, the dissipation in the loads 12*a* and 12*b* and the compressibility of working fluid within the compliant sub-vessels 101*a*,101*b*.

It is understood that the embodiments herein disclosed may be arranged in a variety of geometric configurations, for example in which the said two vessels are concentric about the same axis, or in which the said two vessels are combined. Furthermore, it is understood that the said working fluid may be made up of more than one component. In the heat engine embodiments herein described, regenerator or recuperator means may be applied so as to improve thermal efficiency.

It is preferable, in all embodiments of fluidic oscillators according to the present invention, that the vessels 11, 13 and the conduit 14 are constructed from a material or materials having a low product of specific heat capacity, thermal conductivity and density with the intention that heat transfer between the working fluid and the vessels 11,13 and the conduit 14 is minimised.

Figure 12:
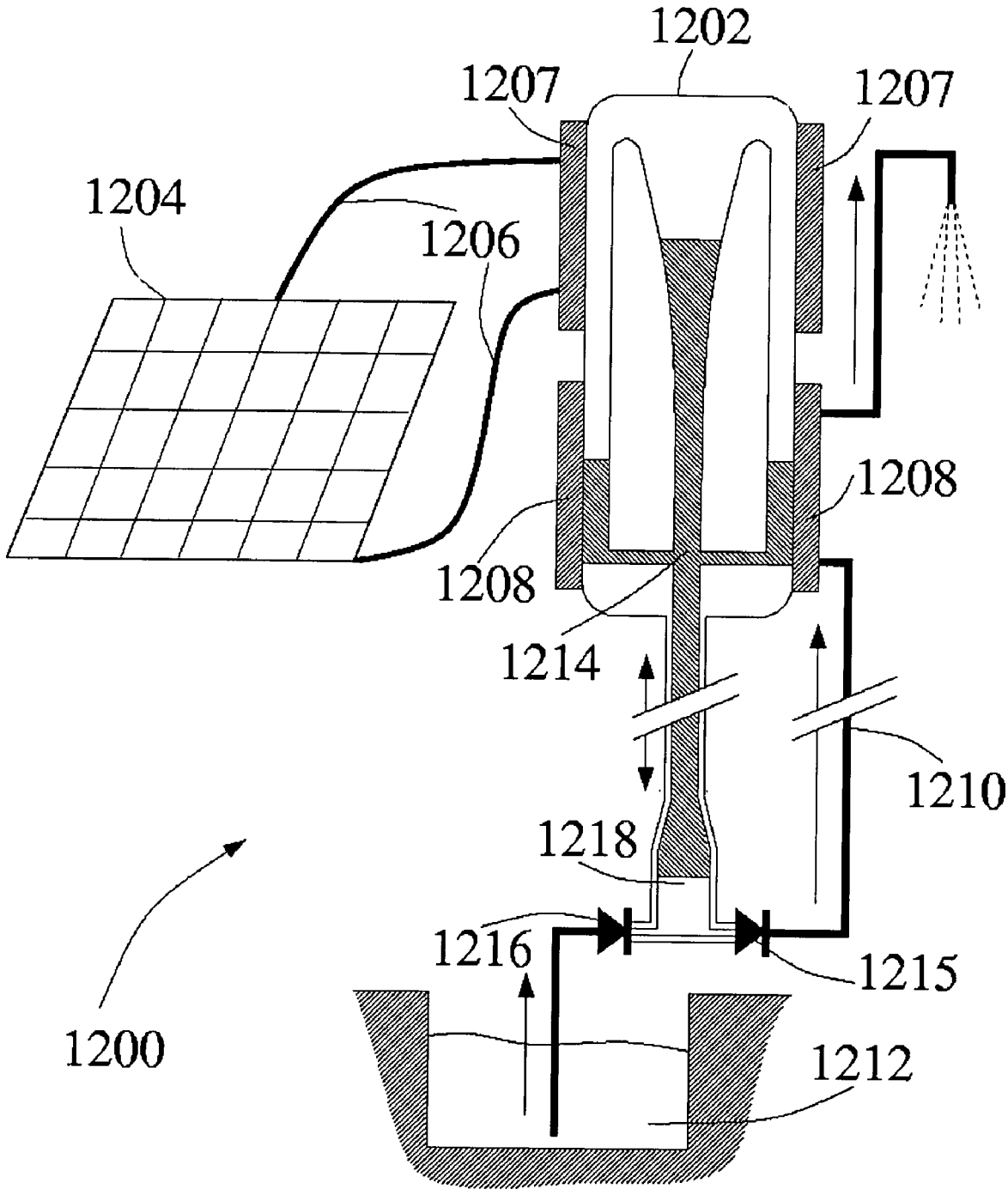
FIG. 12 is a representation of a solar irrigation pump comprising a heat engine according to an aspect of the present invention.

Referring now to FIG. 12, a solar irrigation pump 1200 comprises a heat engine 1202, a solar thermal collector 1204, typically a solar panel, a heat pipe or thermo-siphon 1206, and a tube 1210 placed in a reservoir 1212 of fluid to be pumped, typically water.

The heat engine 1202 can be any one of the heat engines as described hereinbefore, or a heat engine operating according to similar principles thereto.

The solar collector 1204 typically comprises the hot end of the heat pipe or thermo-siphon 1206. Evaporation or convective heating at the hot end of the heat pipe or thermo-siphon 1206 gives rise to condensing or convective cooling on the outside of a hot heat exchanger 1207 of the heat engine 1202 so that the solar collector acts to heat the hot heat exchanger 1207.

The tube 1210 is connected to the outside of a cold heat exchanger 1208 of the heat engine 1202 such that fluid exiting the reservoir 1212 acts as a coolant of the cold heat exchanger 1208. The temperature difference between the hot and cold heat exchangers 1207 and 1208 of the heat engine 1202 causes the working fluid 1214 of the heat engine to oscillate. In one embodiment, the working fluid 1214 is immiscible with the fluid to be pumped, for example if water is to be pumped, a hydrocarbon working fluid may be used. The interface between the working fluid and the fluid to be pumped 1218 acts as a piston face in a conventional pump, this can obviate the necessity for moving parts in such a pump.

The outstroke of the working fluid 1214 forces the fluid to be pumped so as to force open a non-return outlet valve 1215 to output the pumped fluid. The outlet valve 1215 closes as the outstroke finishes and the return stroke commences.

On the return stroke of the pump a non-return inlet valve 1216 opens and the volume left by the retreating interface is filled by fluid extracted from the reservoir 1212 through tube 1210. This fluid is then used to further cool the cold heat exchanger 1208 before it is subsequently used, for example for irrigation.

In a further embodiment of the pump 1200 a flexible bag, diaphragm or other flow separation means separates the working fluid and the fluid to be pumped. The diaphragm is used to transfer the work between the working fluid and the fluid to be pumped in order to affect pumping of the fluid to be pumped. This separation of the working fluid from the fluid to be pumped allows a wider variety of working fluids to be used as it ensures no mixing of the fluids.

Figure 13:
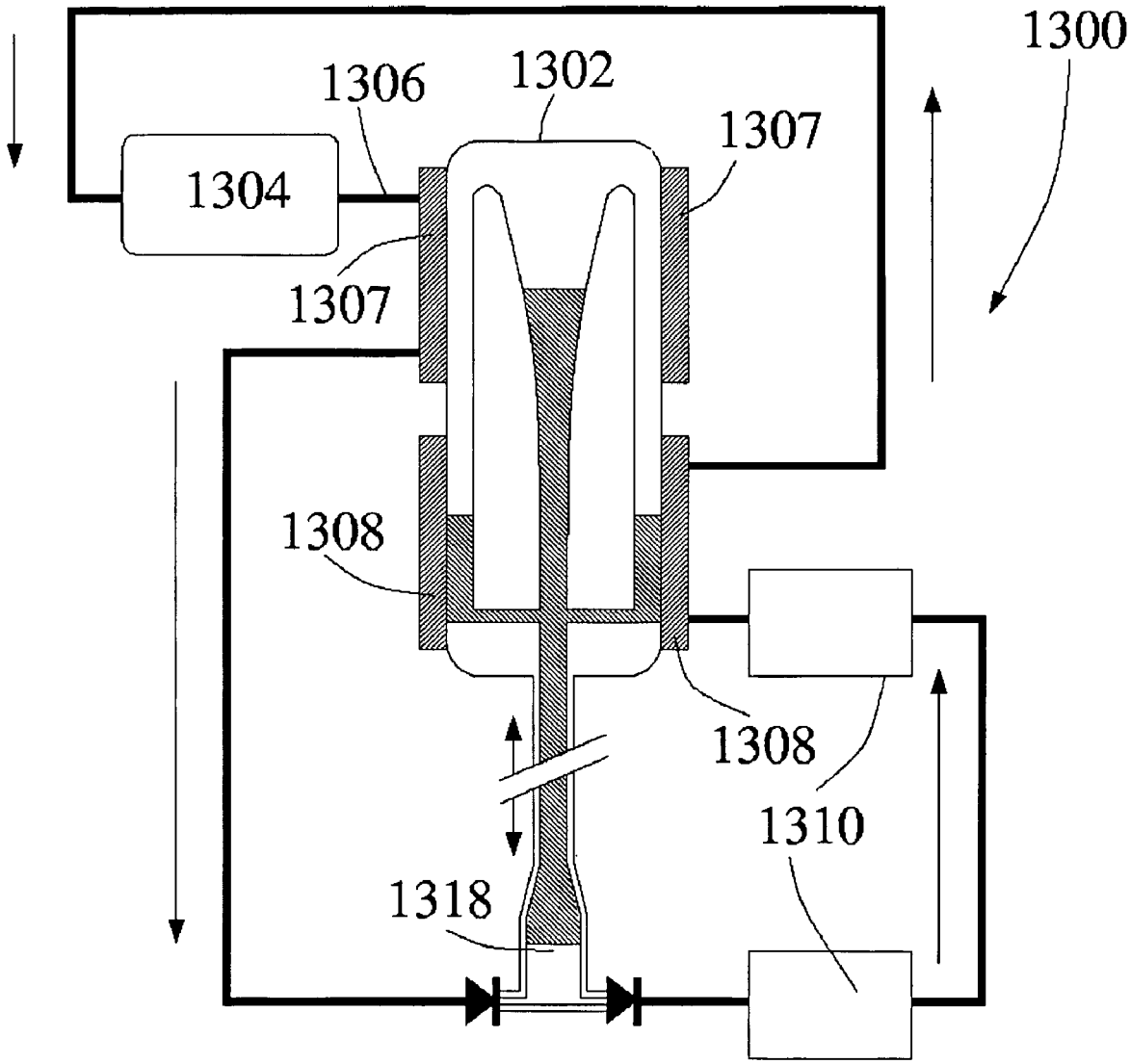
FIG. 13 is a representation of a hot water pump, suitable for use in a home heating system, comprising a heat engine according to an aspect of the present invention.

Referring to FIG. 13, a domestic hot water circulation system 1300 comprises a heat engine 1302, a water heater, typically a gas or oil fired water heater 1304 and radiators 1310. The water heater 1304 is connected to the heat engine via conduit 1306. The difference in temperature between the primary heat exchanger of the boiler 1304 and the temperature of the water returning from radiators 1310 can be used to heat a hot heat exchanger 1307 and cool a cold heat exchanger 1308 of the heat engine 1302 respectively, and the work generated by the heat engine can be used to pump the water around the circulation system. It is understood that other available sources and sinks of heat, such as hot flue gases and mains water entering the building respectively, may be preferred.

The water heater 1304 supplies hot water to the outside of the hot heat exchanger 1307 of the heat engine 1302. The radiators 1310 supply cooled water to the outside of the cold heat exchanger 1308. The temperature difference between the hot and cold heat exchangers 1307 and 1308 of the heat engine 1302 causes the working fluid to oscillate between the hot and cold sides of the heat engine, and generates work in the load of the heat engine. The load comprises a pump 1318 to pump water from the water heater 1304, around the hot heat exchanger 1307 and on to radiators 1310 distributed around the system 1300. After the water has passed through all of the radiators 1310, it has cooled sufficiently to provide a cooling effect to the cold heat exchanger 1308.

The main advantage of using the heat engine according to the present invention in domestic heating systems is that electricity is not required to pump water around the system. The amount of electricity used to pump water around a domestic heating system is typically 10% of net domestic consumption, and the present invention therefore offers a significant reduction in electricity consumption. The heat engine is also capable of self-starting in the presence of a heat source, which offers the possibility of eliminating costly and unreliable control systems.

Any system that has an existing temperature differential can be exploited to generate work by using a heat engine according to the present invention. Such systems can include using the heat engine to pump liquid around refrigeration/air conditioning systems, power generation systems and other systems in which thermally driven pumping is relevant.

The invention claimed is:

1. A fluidic oscillator comprising:

at least one vessel arranged to contain a working fluid;

a pressuring means for pressurising said working fluid;

a de-pressurising means for de-pressurising said working fluid;

wherein said pressurising and de-pressurising causes said working fluid to move in and out of said at least one vessel;

at least two time delay mechanisms associated with said working fluid to cause a phase shift between changes in mass and pressure of working fluid in said at least one vessel; and including a gain mechanism that gives rise to a gain;

wherein each said time delay mechanism comprises a dissipative process and a capacitive process, and wherein said gain is sufficient that in normal operation the magnitude of said pressure changes in said working fluid increases or remains constant with time to permit steady oscillations independent of the inertia of the working fluid; and further comprising a plurality of heat exchangers for giving rise to a flow of heat into and from said at least one vessel, and wherein said fluidic oscillator is configured such that, in operation, a total phase shift between a flow of heat through said heat exchangers and a saturation temperature of said working fluid in said at least one vessel is close to a value required to give a maximum difference between mean heat addition and heat rejection temperatures for the pressure amplitude within said working fluid during said operation; and wherein each said time delay mechanism is dominated by said dissipative process and said capacitive process or wherein said fluidic oscillator further comprises two said working vessels coupled by saturator means and a conduit, said fluidic oscillator being coupled to a load, and said load has inertance with reactive impedance with a magnitude substantially equal to that of a compliance contained within said saturator and said conduit at a frequency of oscillation of the fluidic oscillator.

2. A fluidic oscillator as claimed in claim 1 configured as a heat engine which, when coupled to a load, has a load phase shift between displacement and pressure of working fluid in said load which in said normal operation matches said phase shift between changes mass and pressure of working fluid in said at least one vessel.

3. A fluidic oscillator as claimed in claim 1 configured as a heat engine and further comprising high and low pressure working fluid reservoirs for supplying and removing working fluid respectively to and from said at least one vessel.

4. A fluidic oscillator as claimed in claim 1 configured as a heat engine and further comprising a second vessel from which working fluid is coupled to a load, wherein said working fluid has a passive gas component mainly occupying said second vessel, the fluidic oscillator further comprising a diffusion column or separation chamber to separate said passive component of said working fluid from an active component of said working fluid giving rise to said pressure changes in said working fluid.

5. A fluidic oscillator as claimed in claim 1 configured as a heat engine and further comprising a second vessel from which working fluid is coupled to a load, wherein said working fluid is part vapour and part liquid, said first and second vessels being coupled by a conduit for said vapour and through a restriction for said liquid, for controlling said phase shift between changes mass and pressure of working fluid in said at least one vessel.

6. A pump comprising the fluidic oscillator of claim 1.

7. A method of operating a fluidic oscillator, the fluidic oscillator comprising:

at least one vessel arranged to contain a working fluid;

a pressuring means for pressurising said working fluid;

a de-pressurising means for de-pressurising said working fluid;

wherein said pressurising and de-pressurising causes said working fluid to move in and out of said at least one vessel;

at least two time delay mechanisms associated with said working fluid to cause a phase shift between changes in mass and pressure of working fluid in said at least one vessel;

a gain mechanism that gives rise to a gain; and a plurality of heat exchangers for giving rise to a flow of heat into and from said at least one vessel;

the method comprising configuring said fluidic oscillator such that said time delay mechanisms each comprise a dissipative process and a capacitive process to thereby permit steady oscillations independently of the inertia of said working fluid; and wherein, in operation, a total phase shift between a flow of heat through said heat exchangers and a saturation temperature of said working fluid in said at least one vessel is close to a value required to give a maximum difference between mean heat addition and heat rejection temperatures for the pressure amplitude within said working fluid during said operation; and wherein each said time delay mechanism is dominated by said dissipative process and said capacitive process or wherein said fluidic oscillator further comprises two said working vessels coupled by saturator means and a conduit, said fluidic oscillator being coupled to a load, and said load has inertance with reactive impedance with a magnitude substantially equal to that of a compliance contained within said saturator and said conduit at a frequency of oscillation of the fluidic oscillator.

8. A fluidic oscillator comprising:

a. first and second vessels arranged to contain a working fluid, the cross sectional area of said second vessel being minimised within limits set by surface tension and the cross sectional area of the first vessel being less than two times greater than the cross sectional area of the second vessel;

b. a first coupling conjoining the first and second vessels so as to subject said two vessels to a common pressure;

c. a second coupling to communicate a volume of working fluid contained within the first vessel to the second vessel;

d. drive mechanism to provide pressure changes in the working fluid, located substantially within the second vessel;

e. a load comprising dissipative and reactive components giving rise to a load phase angle between the mass of working fluid contained within the first vessel and the pressure changes therein due to said load;

f. a third coupling to couple the working fluid in the first vessel to said load such that changes in the volume of the working fluid contained in said first and second vessels give rise to transfer of work between the first vessel and the load;

g. a gain mechanism configured to provide viscous drag, hydrostatic pressure changes due to a flow, and thermal resistance;

h. the compliance of said working fluid and the reactive component of said load being arranged to resonate at frequency of oscillation, determined by said dissipative and reactive components and said gain.

9. A fluidic oscillator comprising:

a. first and second vessels arranged to contain a working fluid;

b. a first coupling conjoining the first and second vessels so as to subject said two vessels to a common pressure;

c. a second coupling to communicate a volume of working fluid contained within the first vessel to the second vessel;

d. a drive mechanism provide pressure changes in the working fluid, located substantially within the second vessel;

e. a load comprising dissipative and reactive components giving rise to a load phase angle between the mass of working fluid contained within the first vessel and the pressure changes therein due to said load;

f. a third coupling to couple the working fluid in the first vessel to said load such that changes in the volume of the working fluid contained in said first and second vessels give rise to transfer of work between the first vessel and the load;

g. a gain mechanism configured to provide viscous drag, hydrostatic pressure changes due to a flow, and thermal resistance;

h. the compliance of said working fluid and the reactive component of said load being arranged to resonate at the frequency of the oscillations, determined by said dissipative and reactive components and said gain.

10. A fluidic oscillator according to claim 8, in which said working fluid is part liquid and part gas or vapour within the vessels, said fluidic oscillator further comprising a coupling to permit a flow of liquid between the first vessel and the second vessel driven by the hydrostatic pressure difference at a lower portion of each said vessel due to the liquid therein, and wherein said coupling to permit said flow of liquid is further configured to provide a viscous drag to give rise to a phase shift between the liquid levels in said first and second vessels.

11. A fluidic oscillator according to claim 8, said fluidic oscillator further comprising a coupling to connect said vessels to reservoirs of high or low pressure, located substantially within the second vessel, and pressure sources having a pressure difference there between coupled to said pressure reservoirs.

12. A method as claimed in claim 7 wherein said heat exchangers are configured to alternately evaporate and condense said working fluid, and wherein, in operation, said oscillator has a load phase shift and a feedback phase shift each of substantially 90 degrees and a thermal phase angle of substantially 0 degrees.

13. A fluidic oscillator as claimed in claim 1 comprising first and second said vessels, and wherein said first vessel has a cross-section which is larger at each end than between the ends of said first vessel.

14. A fluidic oscillator as claimed in claim 8 wherein said first vessel has a waist in a central region of first vessel.

15. A fluidic oscillator as claimed in claim 9 wherein said first vessel has a waist in a central region of first vessel.

* * * * *